United States Patent [19]

Stephens

[11] 4,004,569

[45] Jan. 25, 1977

[54] METHOD AND APPARATUS FOR REMOVING SET MORTAR FROM RECOVERED BUILDING BRICKS

[76] Inventor: Paul B. Stephens, 1234 South Wabash Ave., Chicago, Ill. 60605

[22] Filed: May 19, 1975

[21] Appl. No.: 578,628

[52] U.S. Cl. ..... 125/26

[51] Int. Cl.[2] ..... B28D 1/00

[58] Field of Search ..... 125/26

[56] References Cited

UNITED STATES PATENTS

| | | | |
|---|---|---|---|
| 133,893 | 12/1872 | Schleier | 125/26 |
| 1,397,227 | 11/1921 | Minor | 125/26 |

FOREIGN PATENTS OR APPLICATIONS

| | | | |
|---|---|---|---|
| 419,782 | 10/1925 | Germany | 125/26 |
| 658,614 | 3/1938 | Germany | 125/26 |

*Primary Examiner*—Harold D. Whitehead
*Attorney, Agent, or Firm*—John Harrow Leonard

[57] ABSTRACT

A method of, and apparatus for, applying to the original set mortar adherent to the faces of a used brick components of force so directed as to remove the mortar from the faces. The forces are applied to the mortar on opposite side and edge faces of the brick concurrently so as to relieve the brick from bending stresses. These forces have components directed inwardly of the brick and also in directions along and across the faces of the brick for wedging, shearing, cracking, and abrading the mortar off the faces. The forces are applied as the brick is moved along a predetermined path, and are progressively increased as the brick advances, except at those surface areas at which the mortar to which the forces are applied has been removed or reduced in thickness. The freed mortar passes immediately from the site of application of the removal forces. The original faces of the bricks are not marred or scarred noticeably and the bricks are not chipped or broken, by the applied forces.

17 Claims, 22 Drawing Figures

S
W
V
T
24
25
26
16
2a
34 33
34
10
5
5
3
Y
1
6
46
2
29
28
33
34
30
27
27
34 27 33 34
R
4
43b
45
43
43a
42

2a
16
41 40 40a
39
14
14
8
14
6
2
12

2
10
4
10
8
6
46
6
10

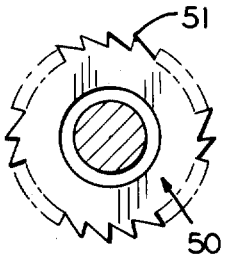
FIG. 14
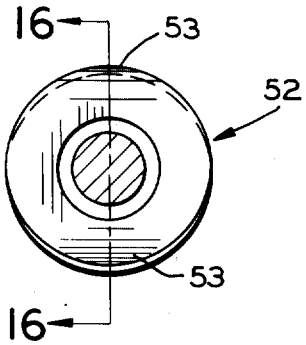
FIG. 15
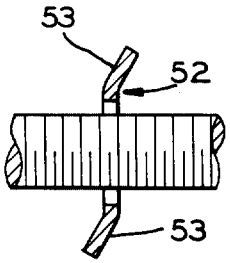
FIG. 16
FIG. 17
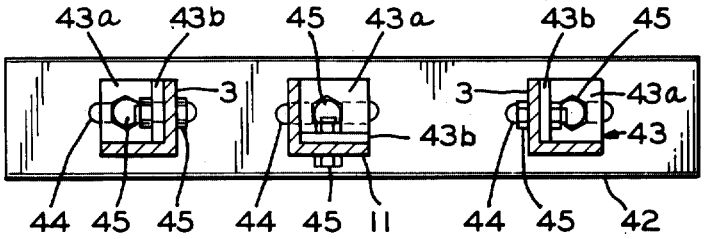
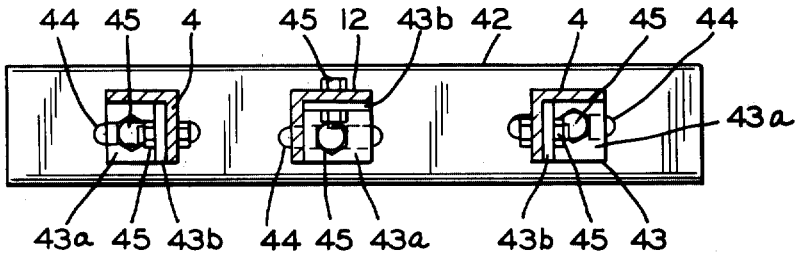
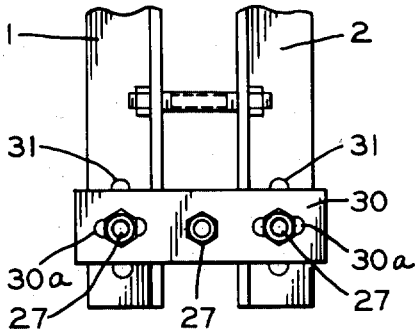
FIG. 18
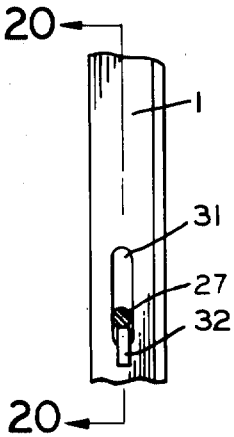
FIG. 19
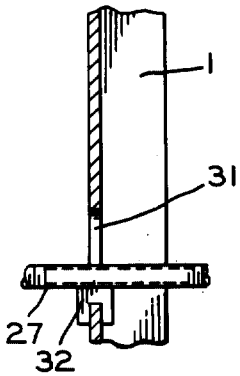
FIG. 20

METHOD AND APPARATUS FOR REMOVING SET MORTAR FROM RECOVERED BUILDING BRICKS

BACKGROUND OF THE INVENTION

1. Field of Invention

Cleaning method and apparatus.

2. Description of the Prior Art

For many years there has been a market demand for reclaimed bricks from buildings which have been torn down, as in urban renewal areas. Generally, the buildings are torn down by demolition charges which drop the entire building onto its original ground site, or the walls are broken apart and knocked down by the use of a swinging demolition ball or "skull cracker". In either case the impact forces break the walls into brick and motar agglomerations of various sizes incorporating a few or many bricks. Generally, many of the bricks ae freed or loosened somewhat from the agglomeration by the impact of the mass when it is struck by the ball or when it strikes the ground or rubble on the landsite upon falling. The bricks remaining agglomerated can be broken free from the mass readily, but the original mortar usually adheres to all or some of the faces of the freed bricks, as initially obtained at the worksite. Usually the mortar adheres in patches of indiscriminate sizes and heterogeneous array, ranging from patches which cover all of the one or more faces to occasional small isolated patches on one or more faces. To reclaim or salvage such bricks for reuse, substantially all of the mortar must be removed without abrading, scratching, or damaging the original faces of the bricks, thus leaving thereon, at most, superificial films or patches of discoloration where some of the mortar has penetrated into the pores and interstices opening in the brick faces.

At present this mortar is removed manually by chisel type tools and hammers. At times, the mortar on the faces is subjected to rotary abrading discs, or power driven belts as the main or final step in cleaning. Reclaiming the bricks by chisels is a rather slow and expensive procedure, largely because the forces applied to the mortar to dislodge the layers thereof, or to reduce its thickness, are highly concentrated or localized sharp impacts, and are often applied to mortar on one face while the opposite face is unbuttressed. Therefore, such forces impose on the brick chipping and bending stresses which often disfigure or fracture the brick or break it apart. Frequently this occurs after much of the mortar has been removed, and as a result the cleaning work already effected is wasted. A further disadvantage in mortar removal in this manner, especially near the brick edges and corners, is localized fracturing and chipping off the such large flakes or chunks that the underlying brick material, with its darker appearance, is exposed, giving a sharp undersirable mottled appearance to the surface or destroying the original geometric shape of the brick. Rotary abrasive discs and belts are very expensive and do not cause the layer of mortar to break free. Instead, the layer must be removed solely by abrading action. As a result, the original brick surface is generally not exposed but carries coextensive thin strata of mortar. Often grinding exposes a new surface as a result of removing a thin strata of the brick material itself. Thus the attractive surface appearance characteristics of used bricks is destroyed.

SUMMARY

In accordance with the present invention, the individual bricks with their adherent mortar are guided and driven endwise along a predetermined processing path and, during such travel, mortar removal forces are applied to the mortar thereon.

The forces impose predominantly two types of components. The components of one type are directed inwardly of the brick from opposite aligned face portions concurrently so that the brick is not subjected thereby to severe bending stresses. The components of the other type are directed along the planes of the faces of the brick, both endwise and transversely of the faces, concurrently with each other and with the inward components, so as to wedge, or break, or shear, loose the mortar in large integral masses from the brick, and to crush, crumble and abrade the mortar not so broken loose. After their initial application, all of these forces are increased progressively as the brick proceeds along its path until the mortar at the points of the application is removed so as to expose the original outer surfaces of the brick, leaving the faces generally intact except for slight isolated superficial films of mortar, or mortar which has penetrated in the interstices in the brick itself, as evidenced by a whitish or frosted surface appearance, giving a pleasantly mottled appearance to structures subsequently built of the reclaimed brick. The original geometric shape of the brick remains substantially intact and noticeable chipping, scrafing, and abrading of the original surfaces are generally avoided.

During this treatment of the wide and edge faces, the mortar on the trailing end face of the brick is loosened, or is sheared, crushed, or abraded therefrom as applied forces move the brick along its path. After all other faces are cleaned, the mortar on the leading end face is subjected to impact, shearing, and abrading forces which remove it therefrom.

These operations are performed on the brick with a powered apparatus such that the mortar which is freed from each brick is immediately removed from the path and operating site in the apparatus, generally by gravity, so that initially removed mortar does not interfere with that subsequently progressively removed as the brick advances.

Various parts of the apparatus used are adjustable so as to be applicable to bricks of various sizes.

BRIEF DESCRIPTION OF THE DRAWINGS

FIG. 14 is a further enlarged view, similar to FIG. 10, showing another modification of one of the abrading washer elements thereof;

FIG. 15 is a view similar to FIG. 14 showing still another modification of one of the abrading washer elements;

FIG. 16 is a fragmentary sectional view taken on the line 16—16 of FIG. 15;

FIG. 17 is a horizontal sectional view showing the manner of mounting the machine on its base support;

FIG. 18 is a fragmentary right side elevation of part of the apparatus, and illustrating the means for adjustment of certain bottom impact tool rods for assuring the proper relation for the particular size of bricks to be cleaned;

FIG. 19 is a fragmentary view, similar to FIG. 18 and partly in section, illustrating the adjustment feature of FIG. 18;

FIG. 20 is a fragmentary vertical sectional view taken on the line 20—20 of FIG. 19;

Figures 1, 21, 22:
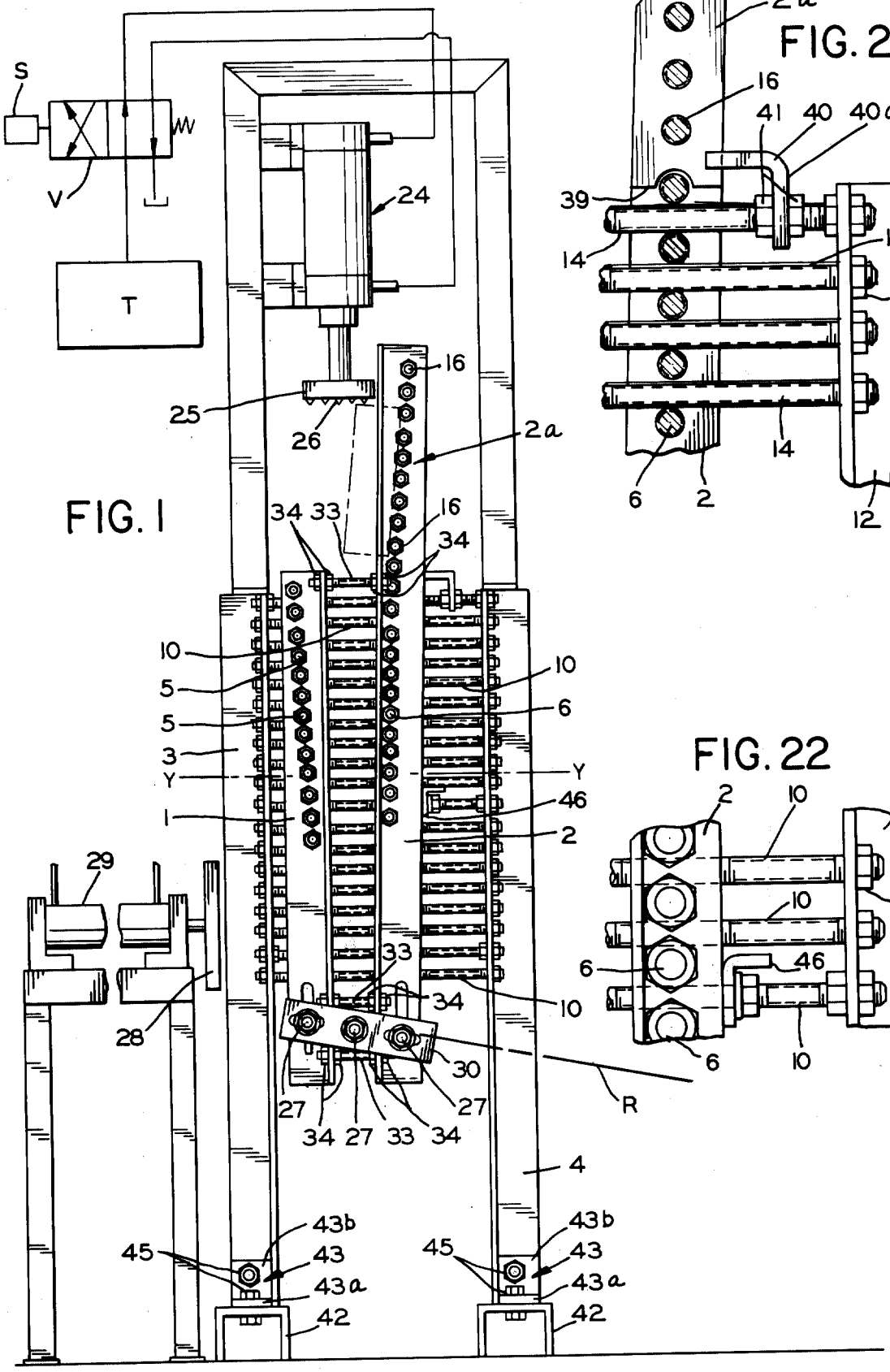
FIG. 1 is a right side elevation, on a reduced scale, of an apparatus embodying the principles of the present invention and operable to perform the method thereof, certain power mechanism and a control therefor being shown diagrammatically.
FIG. 21 is an enlarged fragmentary right side elevation showing an adjustable brace of one of the upright guide frame members of the apparatus illustrated in FIG. 1.
FIG. 22 is a view, similar to FIG. 21, showing another adjustment of the apparatus for accommodation of it to different sizes of bricks.

Referring first to FIGS. 1 through 5, the apparatus is shown as comprising a guide which, in the form illustrated, comprises a pair of generally upright front guide frame members 1 and a pair of rear guide frame members 2 which are aligned with the members 1, respectively, and which extend generally upright, but in upwardly divergent relation rearwardly from the guide members 1. Spaced forwardly from the guide frame members 1 is a pair of outer front upright supporting frame members 3, and rearwardly from the pair of guide frame members 2 is a pair of upright rear outer frame members 4. The guide frame members 1 and 2 are arranged to support tooling defining an upright guiding and cleaning or processing path for bricks to be cleaned. To this end, the pair of front guide members 1 carries a row of rods 5. Each rod 5 preferably has a rough operating peripheral surface extending throughout its length. The rods 5 are arranged in radially spaced relation to each other in a row which extends from top toward the bottom of the pair of front guide frame members 1. Correspondingly, a row of like rods 6 are carried by the rear guide frame members 2, and arranged in like manner to the rods 5.

Figure 8:
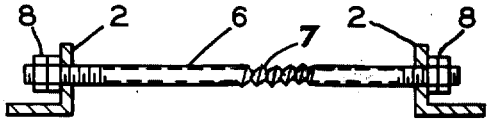
FIG. 8 is an enlarged fragmentary top plan view showing a single one of the rods comprising a tool of the apparatus and showing the manner of mounting it for ease in effecting adjustment of the apparatus.
Figure 9:
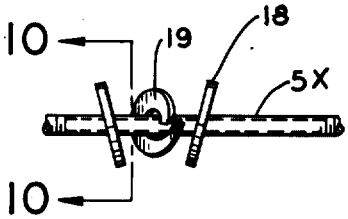
FIG. 9 is an enlarged fragmentary top plan view of one of the initial wedging, crushing, and abrading tools of the apparatus.

In the preferred form of the invention, all of these tool rods 5 and 6 are identical, and such as the rod 6 illustrated in FIG. 8. For example, each rod may be about ½ inch in diameter and threaded throughout its length with a National Coarse Standard thread arranged 13 per inch. The threads have sharpened crests, as indicated at 7 in FIG. 8. As a result, the crests provide shearing, crushing, pulverizing and abrading edges which extend slightly obliquely to the rod axis, and hence to the length of the guide. Because of this obliquity, they impose a shearing action, in a horizontal direction, on the mortar on the face of a brick against which they bear as it passes from top to bottom of the rows of rods 5 and 6. The ends of the rods 5 and 6, extend through suitable holes in their associated guide frame members 1 and 2. At each of its outer ends each rod carries lock nuts 8 so that the length of the rod exposed between its associated guide frame members can be adjusted and assist in maintaining a fixed adjusted spaced relation between the inner faces of the guide frame members 2.

Correspondingly, series of rods 10 of like structure extend from each of the outer front frame members 3 to the aligned outer rear frame members 4. The rods 10 are arranged in rows in radially spaced relation to each other so that a forward portion of each rod 10 lies between, and preferably engages, each of two adjacent rods 5 in the row in the guide frame members 1, and a rearward portion of each rod 10 lies between, and preferably engages, each of two adjacent rods 6 of the row in the guide frame members 2. The axis of each rod 6 is preferably coplanar with the axis of a corresponding one of the rods 5.

In order to handle two bricks at a time, side by side, for increased production, an intermediate outer front frame member 11 and an intermedate outer rear frame member 12 are disposed between the pair of outer front frame members 3 and the pair of outer rear frame members 4, respectively. A row of tool rods 14, similar to the rods 10, are carried by the members 11 and 12 and extend front to rear of the guide. Each rod 14 passes between and engages two adjacent rods 5 of the front row and two adjacent rods 6 of the rear row.

As best illustrated in FIG. 1, the rows of rods 5 and 6 converge downwardly from the upper end of the path, as also do the rows of rods 10 in the pairs of front and rear outer frame members 3 and 4. For economy, a single row of rods 14, arranged in a straight vertical row midway between the outer rows of rods 10, is employed, the convergence of the rows of rods 5 and 6 providing the necessary transverse convergence.

The rows of rods thus define two processing passages for the bricks, each of which processing passages is rectangular in cross section with the wide sides at the front and rear of the guide and with all four sides converging toward a common axis from top to bottom of the path.

The bricks are fed into each processing passage at the top, oriented with the leading end downwardly, its wide faces facing forwardly and rearwardly of the guide, and its edge faces facing laterally of the guide. Since the two passages function in like manner, only one is referred to hereinafter.

The size of the cross section of the processing passage defined by the rods is such that a brick with full thickness of the mortar of the original joints adhering to all faces can be introduced therein at the entrance. The cross section of the passage, proceeding from a position at the top downwardly, is progressively less in size until a throat portion, at the level indicated by the line y—y in FIG. 1, is reached. From this level downwardly a distance equal to the diameter of four to six rods, the cross section of the throat portion remains substantially unchanged. The cross section of the throat portion is optimally the same as that of the particular size of brick to be processed. In practice, however, it is usually made slightly larager so that the tool rods do not dig into, or scratch, mar, or chip the original brick surface. Generally, most of the mortar on the wide and edge faces of the brick, except slight superficial strata, as described, are removed in advance of the entry of the brick into the throat. As the brick passes through the throat, a finishing operation is performed by which the last vestiges of the mortar layer are generally removed. The entire passage thus defined has ample openings at each of its four sides, between adjacent spaced rods, so that any mortar broken loose or abraded from the bricks can escape readily and not pack within the passage and throat.

Here it is to be noted that the guide frame members 2 have upper end portions 2*a* which extend above the upper ends of the guide frame members 1 and which carry a row of tool rods 16, corresponding to the tool rods 5 and 6. This row of rods 16 slopes upwardly from the front to the rear of the apparatus at a greater angle than the row of rods 6. The front of the apparatus is open at this location so that bricks to be cleaned can be slapped, rear wide face foremost, against the rods 16 with the brick extending endwise of the guide frame and thus in position to be fed downwardly through the processing passage. This feeding impact against the tool rods 16 loosens and fractures some of the mortar. The change in angle of the row of rods 16 relative to the row of rods 6 is important in manipulating and cleaning the bricks, as will be described later herein.

Figure 2:
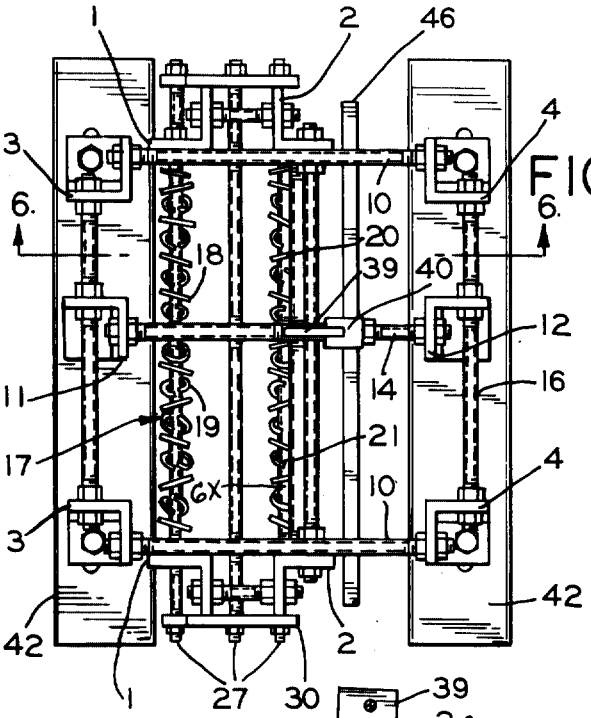
FIG. 2 is an enlarged top plan view of the apparatus of FIG. 1, with the power mechanism omitted for clearness in illustration.
Figure 10:
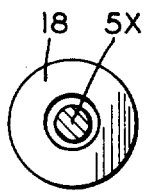
FIG. 10 is a cross sectional view taken on the line 10—10 of FIG. 9, showing one of the migratory wedging and abrading washer elements of the tool of FIG. 9.
Figure 11:
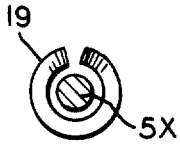
FIG. 11 is a viewer similar to FIG. 1. showing a companion one of the wedging and abrading washer elements of the tool illustrated in FIG. 9.
Figure 6:
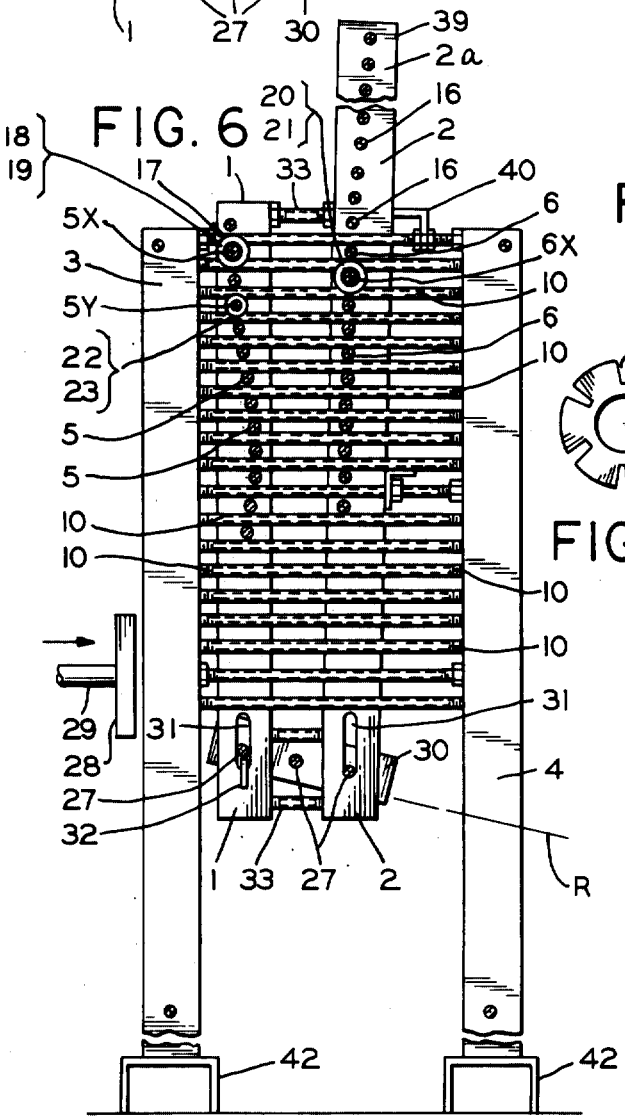
FIG. 6 is a vertical sectional view of the apparatus taken on line 6—6 in FIG. 2.
Figure 3:
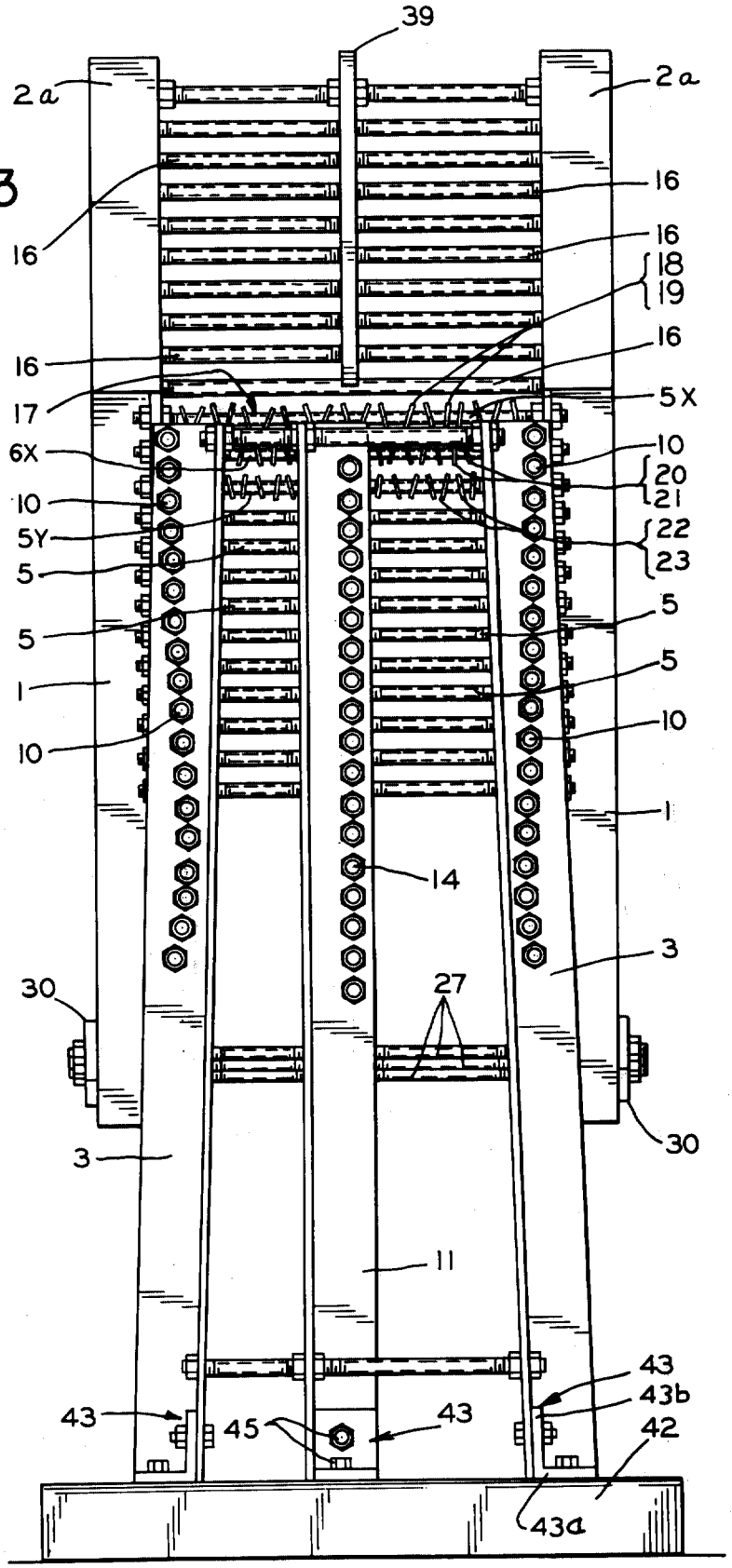
FIG. 3 is a front elevation of the apparatus illustrated in FIG. 2.
Figure 4:
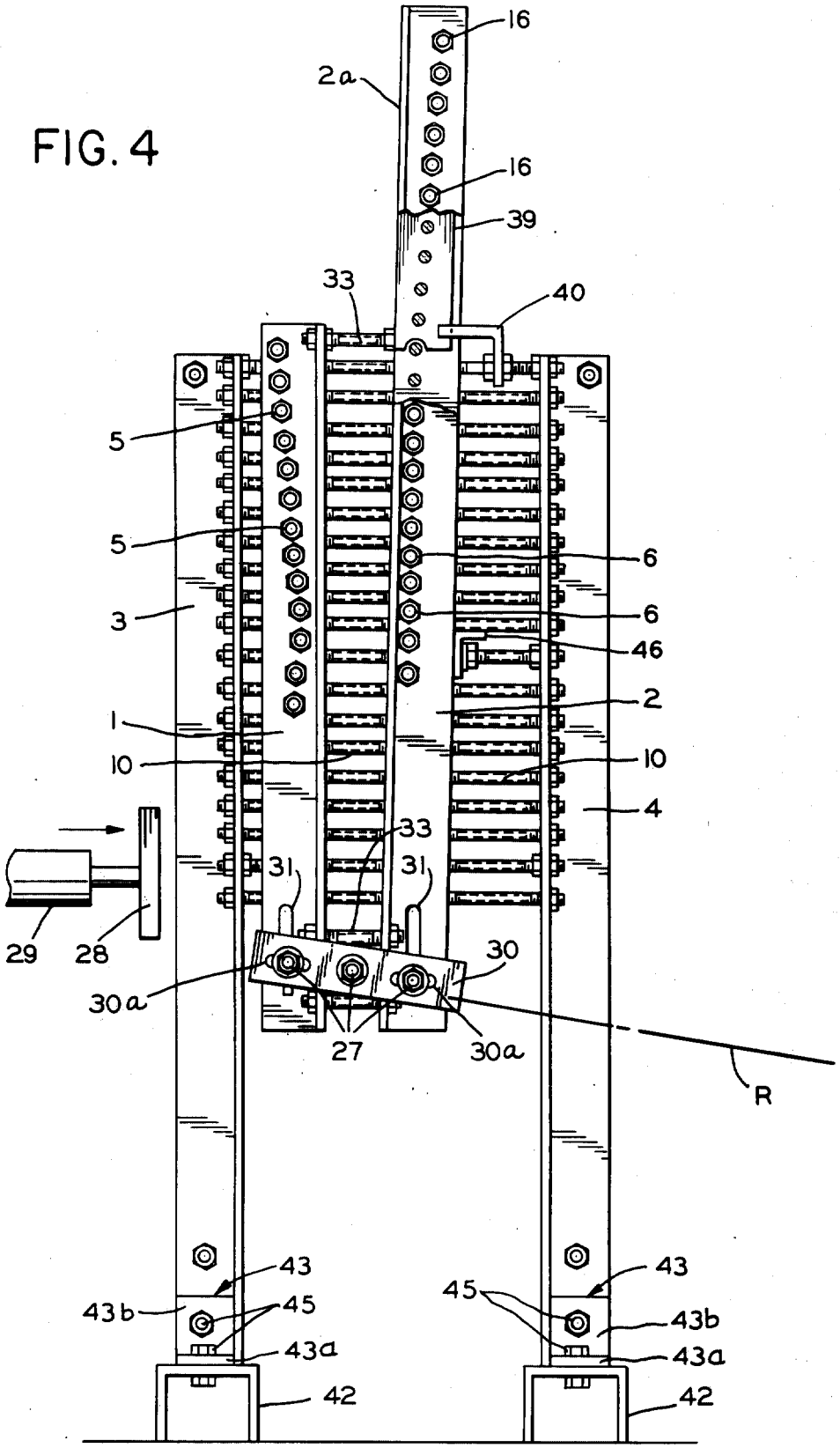
FIG. 4 is a right side elevation of the structure illustrated in FIGS. 2 and 3.
Figure 5:
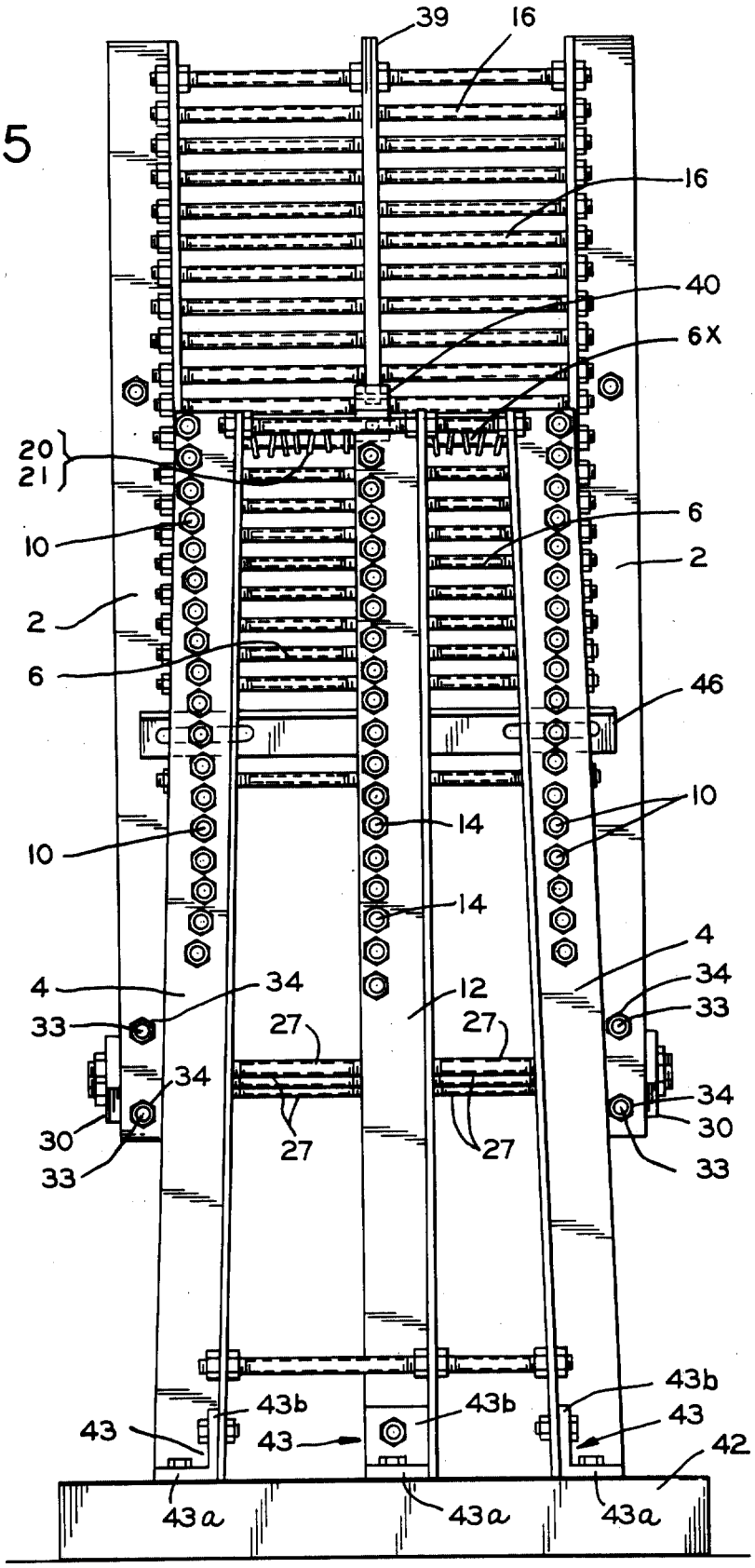
FIG. 5 is a rear elevation of the structure illustrated in FIGS. 2 through 4.

As best illustrated in FIGS. 2 and 3 and, particularly FIG. 6, adjacent the intersection of the lower end of the upper row of rods 16 with the upper end of the lower row of rods 6, one of the rods 5, as indicated at 5*x*, and as best shown in FIG. 6, carries a wedging and abrading tool, indicated generally at 17. This tool is in the form of a series of separate migratory elements, preferably comprising washers 18 of the solid type alternated with spiral or lock type spring washers 19. All of the washers have central openings of diameter considerably greater than that of their associated rods 5, and are loosely supported on the rod 5 so that they can float of migrate limited distances, both with and independently of each other axially along the rod 5*x*, and also can rock transversely of their axes independently of each other. As a result, they self-adjust themselves in infinitely variable and continuously changing heterogeneous array, — their axes tilted to different degrees relative to the axis of the associated rod, they themselves rotated to a multiplicity of positions about their axes and shifted and bunched or widely spaced endwise of the rod 5*x*. As the mortar on the leading or front end face of the brick, as the brick is forced along the row of rods 16, is engaged by the washers, the brick is deflected rearwardly, thus being rocked to a position more nearly parallel to the row of rods 6.

A corresponding rod 6*x*, carrying a like series of washers, indicated respectively at 20 and 21 in FIG. 2, and arranged in the same manner as those on the rod 5*x*, is positioned immediately beneath that one of the rods 10 which is immediately beneath the rod 5*x* in the front row of rods 5. Correspondingly, another such rod, 5*y*, with a like series of washers 22 and 23, respectively, thereon, is provided, and it is immediately beneath that rod 10 which is beneath the rod 6*x*.

Figure 7:
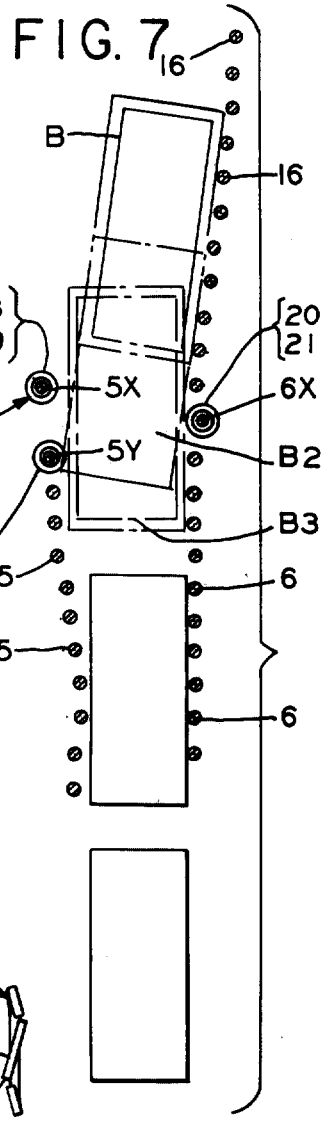
FIG. 7 is a diagrammatic right side elevation of a portion of the apparatus, showing the manner of progression or travel of a mortar coated brick therethrough.
Figure 12:
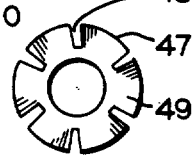
FIG. 12 is an end view of a modified form of the wedging and abrading washer element of FIG. 10.

The reasons for these arrangements and spacings are illustrated in FIG. 7, in which there is shown a brick with adherent mortar thereon indicated in a first position at B, in in which position the brick rests against the rods 16 at its rear face. Upon being pressed downwardly endwise, the mortar on the front face first engages the washers on the rod 5*x*. These washers exert a shearing force on the mortar in a direction generally parallel to the forward face of the brick, and thus laterally of the front face and longitudinally of the brick. Also they impose a turning moment which forces the lower or leading end of the brick toward the rear of the guide. This causes the mortar at the leading end of the rear face of the brick to be engaged by the washers on the rod 6*x*, as indicated by $B_2$. As the brick progresses further downwardly, the cleaned or partially cleaned leading margin of the front face of the brick engages the washers on the rod 5*y* which swing the brick to a more nearly upright position, indicated at $B_3$, in which it is ready to proceed endwise downwardly through the remainder of the passage and its throat.

As the brick proceeds downwardly, the scraping, wedging, crushing, shearing, and abrading action of the washers, and of the threaded rods 5, 6, 10 and 14, progressively remove the mortar from the faces of the brick. The shearing and abrading components of forces are imposed on all faces and are generally parallel to, and transversely of, the associated faces.

The crushing and cutting components of force are directed inwardly of the brick, substantially normal to the faces. However, in all positions, the brick is buttressed opposite the crushing components of force and is thus relieved from severe bending stresses which would tend to break or fracture the brick. Due to these various components of applied force, some of the mortar pops off as a unitary slab, coextensive in size with its associated face; some breaks off in like fashion, but in separate patches; other patches, more adherent, are removed by crushing and abrading. Regardless of the sizes and shapes of the removed portions, they can readily escape from the processing passage by passing out through the spaces between the rods 5, 6, and 10.

Since the rows of tool rods converge and thus become progressively closer together in the direction of movement of the bricks downwardly, the components of force applied to the mortar on the faces of the bricks progressively increase, except insofar as the engaged mortar layer is reduced by being broken off, crushed, or abraded.

In almost all cases, the mortar is much less hard and compact than the brick, and its bond is less than that between different portions of the brick. Hence, since the brick is relieved from severe bending stresses and concentrated localized severe impact forces, the mortar is removed with very little breakage or chipping of bricks.

Usually the greatest difficulty in removing the mortar is removing it from the wide front and rear faces of the brick. When this is removed the removal from the edge faces of the brick is less difficult.

In the present apparatus, as the brick moves downwardly, the mortar usually is largely removed from, or reduced or loosened at, the front and rear faces by the elements on the rods 5x, 5y and 6x, before the edge faces are engaged. Accordingly, washers usually are unnecessary on the rods 10, though they may be provided thereon, if desired. The threads on the rods usually are effective enough, once the main layers of mortar have been processed by the washers. Further, more of the rods 5 and 6, and rods 10, along the length of the processing passage, may be provided with like washers arranged similarly to those on the rod 6x, if required.

In order to drive the bricks endwise of the processing passage, a piston and cylinder assemblage 24 is mounted at the top of the apparatus. The piston drives a cleaning tool head 25 along a generally upright path against the trailing end of the brick. The under face of the tool head is provided with tools such as sharp tines or projections 26 which are distributed over the under face. These tools are adapted both to dig into the mortar on the trailing end of the brick and to move laterally of the plane of the trailing face. This later movement is the result of the brick swinging forwardly from its original position generally parallel to the row of rods 16 to a more upright position due to engagement of the leading end of the brick with the washers on the rods 5x and 5y. The tool head is shown in FIG. 1 in a partially advanced position.

The piston is driven by fluid pressure, preferably compressed air from a tank T, under the control of a spring return reversing valve V, driven by a solenoid S. Compressed air is preferred as a power source because its rapid action causes the piston to deliver a forceful initial impact blow on the mortar on the upper or trailing end of the brick when the leading end of the brick is resting against the washers on the rod 5x, and to follow this blow with a steady push. The impact causes the projections 26 to break into the mortar and the swinging of the brick causes the projections to impart shearing and abrading components to the mortar.

As the brick is driven downwardly along the guide, the mortar is removed from the wide and edge faces and trailing end by the rods. Some of the mortar is loosened and broken off the leading end when it engages the washers on the rods 5x and 6x.

The tool rods heretofore described are so positioned that the cross section of the processing passage below the throat entrance is uniform and of the same dimensions as the cross section of the throat entrance, for a distance of three or four rods. The succeeding rods therebeneath are so positioned that the passage walls diverge slightly downwardly. Accordingly, when the brick has advanced so that its trailing end passes through the throat, it can fall relatively freely.

Since the brick is still being subjected to the thrust of the piston, as it leaves the throat and suddenly becomes releases, it is driven with considerable velocity. This movement and kinetic energy are used to crack loose mortar from the leading end face. For cleaning the leading end, transverse supporting tool rods 27, threaded as are the rods 5 and 6, extend across the processing path in a horizontal row a distance below the throat considerably greater than the length of the brick so that the brick will drop endwise thereonto, thus loosening the mortar on the leading end. The brick, while remaining in upright position on the rods 27, is then shoved rearwardly of the machine by a shoe 28 of approximately the size of the front face of the brick and aligned therewith. The shoe is driven by a pneumatic piston and cylinder assemblage 29, controlled in like manner as the assemblage 24, by a reversing valve, not shown.

The rods 27 extend transversely of the processing passage, but the row of rods terminates rearwardly just beyond the rear wall of the passage. The shoe 28 can be driven so as to push the upright brick, parallel to its initial position of rest on the rods 27, off the rear one of the rods, whereupon the brick can drop free of the apparatus, — preferably onto a ramp R so that it passes out of the way of the next succeeding brick. Any mortar dislodged from the leading face drops out between the rods 27.

A shearing tool 46, in the form of an angle iron, is mounted on certain of the tool rods 10 so that its lower edge is at the bottom of the throat and can scrape across the trailing end of an upright brick as the brick is pushed rearwardly by the shoe 28 while resting on the rods 27. For this purpose, the distance between the plane of the top of the rods 27 and under edge of the tool 46 is preferably only slightly larger than the length of the particular size brick being processed.

The outer upright frame members can be adjusted so that the walls defining the space below the throat diverge slightly rearwardly, thus reducing the possibility of a cleaned brick jamming the discharge portion of the apparatus.

Bricks from any given building are usually uniform in size. However, especially in very old buildings, the size used in one building may vary slightly from those in another. Accordingly, a number of parts of the apparatus must be adjustable.

In the present structure, the tool rods 27 must be adjustable vertically and horizontally. For this purpose, the opposite ends of the rods 27 are mounted in straps or plates 30. The central rod 27 extends through a central circular hole in the strap 30. The outer ones of the rods 27, at opposite ends of the row, are mounted at their opposite ends in elongated transverse slots 30a in the plates 30. The outer rods 27 pass also through upright elongated slots 31 in the guide frame members 1 and 2 for adjustment vertically. This slot arrangement permits limited adjustment of the outer rods 27 toward and away from the central rod 27, and also vertical adjustment of all three of the rods 27. The rods 27 carry locking nuts on each end, as shown, for securing them firmly to the guide frame members 1 and 2 in adjusted positions. However, since the rods 27 are subjected to substantial impacts which might not be repelled by the friction clamping force of their lock nuts, suitable U-shaped removable abutments 32 are provided and disposed in inverted position in the slots 31 with the base of the U engaging the bottom edge of the wall of the slot 31 and the arms of the U lying alongside opposite faces of the member 1 in which the slot 31 is formed. Sets of such abutments are provided, each set having a base of a thickness different from that of other sets. Thus, when installed, the bases of the U-shape abutments rest on the bottom walls of the slot 31 and, in turn, the associated rods 27 rest on the top of these bases. Thus the rod is buttressed so that impacts thereon are transmitted directly to the frame members 1. The sets of abutments are usually graded in eighths of an inch so that the rods 27 can be raised or lowered in relation to the usual increments in brick sizes.

The guide frame members 1 and 2 are adjustable toward and away from each other by upper and lower sets of tie bolts 33. These bolts are threaded and carry pairs of companion adjusting lock nuts 34 on their ends, respectively. Thus the guide frame members 1 and 2 may be moved toward and away from each other to different adjusted positions, and also to different angles of convergence, as required for a particular size brick, and secured fixedly in the adjusted position.

The upper portion 2a of the guide, formed by the upper ends of the guide frame elements 2 and their rods 16, has a divider bar 39 engaged at the rear by a bracing bracket 40 which has a notch at its forward end in which the bar 39 seats. The bracket 40, as best illustrated in FIG. 21, has a dependent leg 40a with a hole therein through which extends the top one of the rods 14. Suitable lock nuts 41 are provided for adjusting the bracket 40 fore and aft for bracing the divider 39, and therefore, by way of the rods 16, the rear guide frame members 2.

The pairs of outer frame members 3, 4, 11, and 12 are mounted at their lower ends on beams 42 by means of brackets 43 of which one leg 43a rests on top of a beam 42 and the other leg 43b is secured against one face of the associated one of the members 3, 4, and 11 by a suitable bolt. The beams 42 have elongated slots 44 through which clamping bolts 45 extend. Like bolts 45 also extend through the associated bracket legs 43a. By this arrangement, all of the upright members 3, 4, and 11 and 12, can be adjusted forwardly and rearwardly of the apparatus. Preferably the rear outer frame members 4 are spaced apart a slightly greater distance than the members 3 so that, at the portion just below the level of the throat, and rearwardly therefrom, the rods 10 diverge slightly rearwardly so that the brick pushed rearwardly beyond the throat can fall free of the apparatus. Due to the large number of adjustable features, the adjustment needed in any instance to assure proper passage of te bricks through the apparatus is obtained, even though such may require slight localized warping of some of the rods and the frame members themselves.

Figure 13:
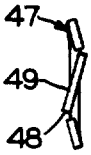
FIG. 13 is a side elevation of the washer element shown in FIG. 12.

Instead of plain washers 18, washers 47 of like size but with radial notches 48 may be used, and the portions 49 of the washers, between the notches, may be twisted out of the normal plane of the washer, as llustrated in FIG. 13. Again, washers 50, as illustrated in FIG. 14, may be used in place of the washers 18. The washers 50 have radial teeth 51. The notches 48 and teeth 51 increase the abrading or pulverizing action of the associated washers on the mortar.

If greater shearing force is required, washers 52, such as illustrated in FIGS. 15 and 16, may be employed. Each of these washers has two diametrically opposite portions 53 bent in opposite directions out of the normal plane of the washers. These bent portions increase the shearing components imposed on the mortar.

Combinations of these washers may be used instead of, or along with the plain washers 18. The spring washers 19 may have different pitches. They are effective for storing energy and building up reactive forces, as the washers 18 are rocked or pushed along their rod by the advancing brick, so as to multiply the shearing thrust the washers 18 eventually deliver to the mortar, so that they act with a snap action as the mortar is broken loose or sheared off.

In order that the processing passage be of the proper cross section throughout its length, while assuring that the bricks can be removed readily after processing, the rows of rods 10, as mentioned, diverge downwardly from the discharge end of the throat. The upright frame members 3 may be divergent downwardly from each other, and also the members 4. This outward divergence is more than offset by the greater degree of downward convergence of the rows of rods 10 from the top to the throat portion of the passage, yet permits assemblage without bending any of the rods 10 or frame members 3 and 4.

Having thus described my invention, I claim:

1. A method of removing set mortar from a used building brick which has opposite side faces, opposite edge faces, and opposite end faces, and comprising:

forcing a used brick, by pressure applied to one end, to travel endwise in one direction, along a predetermined path having four sides, each of which, at each location along its length, is in fixed relation to the other sides, and, as the brick travels along said path, progressively with the travel thereof, applying components of non-yieldable reactive forces to mortar on all of said side and edge faces concurrently, said components being in directions both across and endwise of said path and, in the general planes of each of the associated side and edge faces, respectively, crosswise and endwise thereof;

during said travel of the brick along said path, progressively increasing said components of reactive forces, after initial application thereof, until the mortar is dislodged or is disintegrated; and continuing the travel of the brick and removal of mortar from said side and edge faces until the mortar thereon is removed substantially to its full thickness from the entire side faces and edge faces, respectively.

2. The method according to claim 1 wherein, concurrently with said travel, force is applied to the mortar on the trailing end face of the brick in a manner such that components thereof are in directions parallel to said path and transversely of said path and trailing end face.

3. The method according to claim 2 wherein, after the mortar is removed from said trailing end face, impact forces are applied to the motor on the leading end face of the brick.

4. The method according to claim 1 wherein said components of force are applied to each of said faces at a plurality of areas concurrently, each of which areas is narrow endwise of said path, elongated transversely of said path, coextensive lengthwise with the associated face of the brick, and spaced endwise of the path from the other areas; and said components are applied at each area at a plurality of locations which are in closely spaced relation to each other endwise of their associated area.

5. The method according to claim 1 wherein the initial force applied to the trailing end of the brick to initiate said travel is a sharp impact force delivered to the mortar on the trailing end of the brick.

6. An apparatus for removing old mortar from reclaimed bricks, and comprising:

four open grids, each grid comprising a row of stationary rods spaced, endwise of the row, radially from each other a distance to permit chunks of broken loose mortar to escape between adjacent rods, said grids defining an open ended passage having an entrance at one end, an exit at the opposite end;

said rows of rods converging toward each other from the entrance partway toward the exit, and defining at their location of greatest convergence a finishing and sizing throat;

said throat being slightly larger than the cross section of a building brick to be cleaned; and shearing means on the rods of each row and engagable with the mortar on the brick, and operative, due to the brick being forced along said passage, to apply to faces of the brick reactive shearing components of force directed transversely and endwise of the associated row and reactive crushing components of force directed across the passage in a direction from one side the passage toward the opposite side, for breaking up portions of said mortar, and for shearing other portions thereof from said brick.

7. The apparatus according to claim 6 wherein the shearing means carried by some of the rods are low pitched helical ridges and intermediate valleys, said ridges and valleys extending generally circumferentially of the rods and alternatively with each other endwise of the associated rod.

8. An apparatus according to claim 6 wherein said shearing means on each of certain ones of the rods are a group of annular elements which have a small thickness to diameter ratio and which have central passages with inner diameters which are greater than the outer diameters of their associated rods, the associated rod extending through the central passages in the annular elements; said inner diameters are small enough relative to the outer diameter of their associated rod so that the annular elements on each rod can rock transversely of their axes into binding relation to the associated rods and engage the mortar in their rocked positions and thereby, due to force applied to them by the travelling brick, be resiliently distorted for build-up and release, alternately, of shearing reactive components of force parallel to the associated face of the brick for dislodging chunks of mortar therefrom.

9. An apparatus according to claim 8 wherein spacers are disposed on the rods between adjacent annular elements, respectively, and space them apart and fit between them in a manner such that the annular elements can rock transversely of their axes and migrate limited distances endwise of their associated rod.

10. An apparatus according to claim 9 wherein said spacers are helical spring lock washers having an overall axial length greater than their thickness and having internal diameters greater than the external diameters of their associated rod.

11. The apparatus according to claim 6 wherein said passage defined by the rows of rods is rectilinear in cross section and, near the entrance of passage, three rods are provided and each carries groups of said annular elements; the rods are arranged one at one of the sides of the passage and two at the opposite side of the passage; and said one of the three rods is disposed endwise of the passage so that it is aligned, in a direction from said one wide side toward the other, with the space between said two rods.

12. The apparatus according to claim 6 wherein the rods defining the wide sides of the passage are parallel to each other, and the rods defining the narrow sides are parallel to each other, and pairs of adjacent rods of the wide sides alternate with the pairs of adjacent rods of the narrow sides.

13. An apparatus according to claim 6 wherein a guide extends in a direction generally endwise of the passage and is inclined to the length of, and terminates at the entrance end of the passage at one wide side of the passage so that the brick can move endwise along said guide, slightly obliquely to the length of the passage up to, and into, the entrance of the passage; and the guide is defined by a row of spaced parallel rods, which are parallel to the rods of the wide sides of the passage.

14. An apparatus according to claim 13 wherein a power driven tool is movable endwise of the guide for forcing bricks therealong and into and through the passage;

said tool having a face facing toward the inlet end of the passage and with projections thereon for engaging the trailing end of the brick;

said shearing means are groups of annular elements loosely mounted on some of the rods, respectively, and are positioned so that, when a brick is moved along the guide and engages said elements, it is rocked from its oblique position to a position parallel to the passage and thereby the mortar on its trailing end is moved transversely of the face of the driven tool and of said projections causing them to apply components of transverse pressure and scraping force to the trailing end of the brick.

15. The apparatus according to claim 6 wherein abutments are aligned with said passage and are spaced beyond the throat in a direction away from the entrance end of the passage, in position to engage the leading end of a brick forced entirely through the throat for cracking loose mortar on the leading end.

16. An apparatus according to claim 6 wherein said shearing means are tools having work engaging edges which are slightly oblique to the length of the row.

17. An apparatus for removing set mortar from bricks comprising:

a frame;

stationary force applying tools carried by the frame and arranged in four rows so that their operating portions provide a four-sided elongated passage having an entrance end and of which the sides are convergent in a direction away from the entrance end to a throat portion which in cross section is approximately that of the cross section of a brick, said tools of each row being spaced apart from each other so as to provide lateral passages therebetween large enough to allow ready egress of freed chunks of mortar, dislodged from the brick, from said passage laterally between said tools;

characterized in that means are provided at the entrance end of said passage at opposite sides thereof, in offset relation, endwise of the passage, for engaging the mortar on the opposite wide faces of the brick, while the brick is in a position oblique, endwise, to the passage, and are operable to engage the mortar on said first one face while the brick is in position oblique endwise to said passage, and apply components of force thereto which swing the brick into parallelism endwise with said passage.

* * * * *